US008934818B2

(12) United States Patent
Eiki

(10) Patent No.: US 8,934,818 B2
(45) Date of Patent: Jan. 13, 2015

(54) IMAGE FORMING APPARATUS

(71) Applicant: KYOCERA Document Solutions Inc., Osaka (JP)

(72) Inventor: Takashi Eiki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 15 days.

(21) Appl. No.: 13/858,220

(22) Filed: Apr. 8, 2013

(65) Prior Publication Data

US 2013/0272751 A1 Oct. 17, 2013

(30) Foreign Application Priority Data

Apr. 17, 2012 (JP) ..... 2012-093558

(51) Int. Cl.

| | |
|---|---|
| ***G03G 15/09*** | (2006.01) |
| ***G03G 13/095*** | (2006.01) |
| ***G03G 15/08*** | (2006.01) |
| ***G03G 21/00*** | (2006.01) |

(52) U.S. Cl.

CPC ..... *G03G 13/095* (2013.01); *G03G 15/0808* (2013.01); *G03G 15/09* (2013.01); *G03G 21/0064* (2013.01)

USPC ..... 399/273; 399/267; 399/282

(58) Field of Classification Search

CPC ..... G03G 15/0921; G03G 15/0935; G03G 13/095; G03G 15/0808; G03G 15/09; G03G 21/0064

USPC ..... 399/264, 267, 272–274, 282

See application file for complete search history.

(56) References Cited

U.S. PATENT DOCUMENTS

2012/0051782 A1* 3/2012 Gyoutoku ..... 399/119

FOREIGN PATENT DOCUMENTS

JP 2009-258276 A 11/2009

* cited by examiner

*Primary Examiner* — David Gray
*Assistant Examiner* — Jessica L Eley
(74) *Attorney, Agent, or Firm* — Morgan, Lewis & Bockius LLP

(57) ABSTRACT

An image forming apparatus includes a controller that controls rotational driving of a magnetic roller and rotational driving of a developing roller. The controller is capable of performing a toner collecting mode when no image formation is performed. In the toner collecting mode, the magnetic roller and the developing roller are intermittently rotated in a direction reverse to a direction in which the magnetic roller and the developing roller are rotated during image formation, then the magnetic roller is made to rotate in a forward direction, and then, the magnetic roller is rotated in a backward direction.

9 Claims, 5 Drawing Sheets

IMAGE FORMING APPARATUS

INCORPORATION BY REFERENCE

This application is based on and claims the benefit of priority from Japanese Patent Application No. 2012-093558 filed on Apr. 17, 2012, the contents of which are hereby incorporated by reference.

BACKGROUND

The present disclosure relates to an image forming apparatus such as a copier, a printer, a facsimile, and a multifunction peripheral having functions of those devices, and more specifically, the present disclosure relates to an image forming apparatus that uses a developer containing a toner and a magnetic carrier and develops an electrostatic latent image formed on a photosensitive member by allowing only the toner to be carried on a developing roller.

There are known a single-component developing method and a two-component developing method as methods adopted in developing devices to develop an electrostatic latent image formed on a photosensitive member functioning an image carrier. The two-component developing method, in which a developer containing a toner and a magnetic carrier is used, is capable of maintaining a stable charge amount of toner over a long period of time, and thus is suitable from the viewpoint of life extension. For example, a developing device adopting the two-component developing method holds therein a developer containing a toner and a magnetic carrier such that the developer is fed to a developing roller from an agitating member. The developing roller is provided with an internal magnet, and the magnet allows the developer to be carried on the surface of the developing roller as a magnetic brush. The developing roller rotates to convey the developer toward the photosensitive member. Furthermore, the developing device is provided with a regulation member that regulates the layer thickness of the developer on the developing roller in order to stabilize the amount of developer to be transferred toward the photosensitive member by the rotation of the developing roller. At a position where the outer circumferential surface of the developing roller and that of the photosensitive member face each other, only the toner contained in the developer carried on the developing roller is fed to the photosensitive member to visualize the electrostatic latent image carried on the photosensitive member into a toner image.

When the regulation member regulates the layer thickness of the developer to form a uniform layer of the developer on the surface of the developing roller, part of the toner contained in the developer is scraped off by the regulation member, and such part of the toner floats around the regulation member like a fume. The floating toner adheres to, and gradually collects on, a surface on the downstream side of the regulation member in the rotation direction of the developing roller. The accumulated toner comes off the regulation member to be conveyed by the developing roller to adhere to the photosensitive member, and the adhered toner is finally transferred to a recording medium to cause a defective image.

Thus, in image forming apparatuses, to remove accumulation of toner adhered to the regulation member, a developing bias power supply between the photosensitive member and the developing roller is turned off, the rotation of the photosensitive member is stopped, and further the developing roller is rotated in a direction that is reverse to the direction in which the developing roller is rotated during image formation.

Examples of the two-component developing method include many other methods in addition, to the above-described developing method. For example, there is a developing method where only the toner is carried on the developing roller in developing the electrostatic latent image formed on the photosensitive member. A developing device adopting this developing method includes a magnetic roller that is provided with an internal magnet which allows the magnetic roller to carry a developer containing a toner and a magnetic carrier on its surface as a magnetic brush, a developing roller that is disposed racing a photosensitive member and the magnetic roller, that carries on its surface the toner contained in the magnetic brush that is conveyed by the magnetic roller, and that feeds the carried toner to the photosensitive member, and a regulation member that is disposed a predetermined distance away from the magnetic roller, and that regulates the layer thickness of the developer on the surface of the magnetic roller.

With this developing device, when the toner is fed from the developing roller to the photosensitive member to develop an electrostatic latent image formed on the photosensitive member, residual toner remaining on the surface of the developing roller without being used to develop the electromagnetic latent image may come off from the surface of the developing roller to float around the developing roller. The floating toner falls onto the regulation member that is disposed to be opposed to the magnetic roller. The floating toner also adheres to such part of the internal wall of a developing container that faces the developing roller. Through repeatedly performed the image forming operations, the toner that falls down on the regulation member is accumulated, and more and more toner adheres to the internal wall of the development container, until it falls from the internal wail of the developing container as a cluster of toner. If the accumulated toner or the cluster of toner moves to the developing roller and falls into a gap between the magnetic roller and the regulation member, it will disadvantageously result in a defective image having a defect such as an unwanted vertical line.

The present disclosure aims to provide an image forming apparatus that allows toner alone to be carried on a developing roller to develop an electrostatic latent image formed on an image carrier, and that collects toner that floats around the developing roller without being fed to the image carrier.

SUMMARY

According to an aspect of the present disclosure, an image forming apparatus includes a developing device and a controller. The developing device includes a developing container, a developing roller, a magnetic roller, and a regulation member, and the developing device develops an electrostatic latent image formed on a surface of an image carrier into a toner image. The developing container holds therein a two-component developer that contains a toner and a magnetic carrier. The developing roller is disposed to be opposed to the image carrier by part of an outer circumferential surface of the developing roller being exposed through an opening of the developing container. The developing roller rotates such that part of the outer circumferential surface of the developing roller facing the image carrier moves upward, feeding the toner to the image carrier. The magnetic roller is disposed to be opposed to the developing roller, and the magnetic roller rotates such that, at a position where the magnetic roller faces the developing roller, the magnetic roller moves in a direction that is reverse to a direction in which the developing roller moves, and the magnetic roller carries on a surface thereof a magnetic brush of the two-component developer by using which the magnetic roller forms a toner layer on the developing roller. The regulation member is disposed below the development roller, a predetermined distance away from the magnetic roller. The regulation member regulates the layer thickness of the developer on the magnetic roller. The controller is capable of performing a toner collecting mode when no image formation is performed, the toner collecting mode including: a first rotation in which the magnetic roller and the developing roller respectively rotate intermittently in directions opposite to directions in which the magnetic roller and the developing roller respectively rotate during image formation; a second rotation that is performed after the first rotation and in which the magnetic roller rotates in a direction in which the magnetic roller rotates during the image formation; and a third rotation that is performed after the second rotation and in which the magnetic roller rotates in a direction opposite to the direction in which the magnetic roller rotates during the image formation. Other objects and specific advantages of the present disclosure will become more apparent from the description of embodiments set form below.

DETAILED DESCRIPTION

Hereinafter, embodiments of the present disclosure will be described with reference to the accompanying drawings, but it should be understood that the present disclosure is not limited to these embodiments. Also, the application of the present disclosure described herein and terms used in the description should not be construed in a limited manner.

Figure 1:
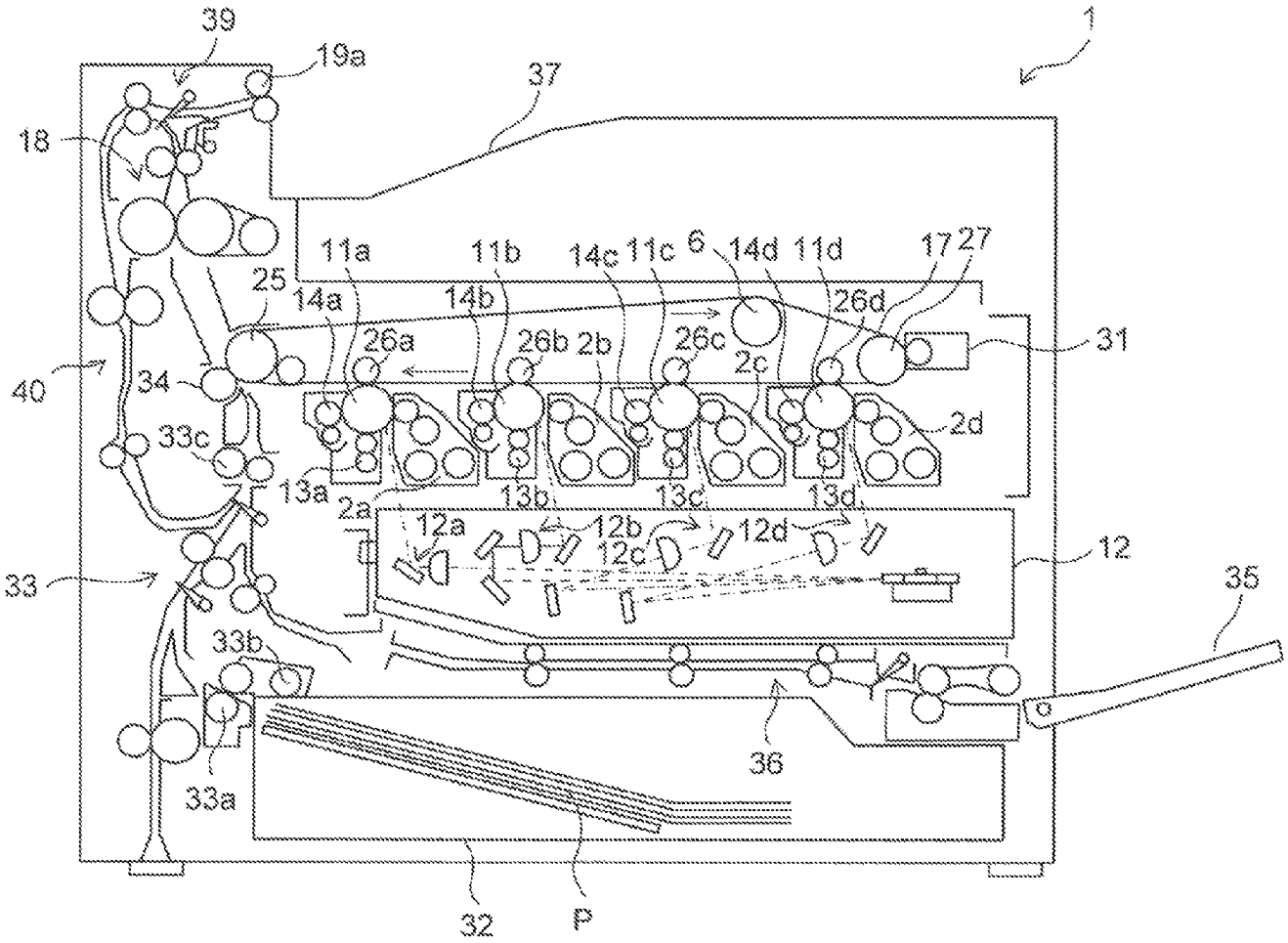
FIG. 1 is a sectional view schematically showing an image forming apparatus according to an embodiment of the present disclosure.

FIG. 1 is a sectional view schematically showing an image forming apparatus incorporating a developing device according to an embodiment of the present disclosure. The image forming apparatus 1 is a tandem color printer. Rotatable photosensitive members 11*a* to 11*d* are arranged corresponding to colors of magenta, cyan, yellow, and black, respectively. Each of the photosensitive members 11*a* to 11*d* includes a photosensitive layer formed of an organic photo conductor (OPC). Around the photosensitive members 11*a* to 11*d*, there are arranged developing devices 2*a* to 2*d*, an exposure unit 12, chargers 13*a* to 13*d*, and cleaning devices 14*a* to 14*d*.

The developing devices 2*a* to 2*d* are disposed to the right of the photosensitive members 11*a* to 11*d*, respectively, the developing devices 2*a* to 2*d* being opposed to the photosensitive members 11*a* to 11*d*, respectively, and the developing devices 2*a* to 2*d* feed toner to the photosensitive members 11*a* to 11*d*, respectively. The chargers 13*a* to 13*d* are disposed at an upstream side of the developing devices 2*a* to 2*d*, respectively, in a rotation direction of the photosensitive members 11*a* to 11*d*. The chargers 13*a* to 13*d* are disposed opposed to surfaces of the photosensitive members 11*a* to 11*d*, respectively, to uniformly charge the surfaces of the photosensitive members 11*a* to 11*d*.

The exposure unit 12, which scans and exposes the photosensitive members 11*a* to 11*d* based on image data that represents letters/characters, patterns, etc., and that is fed to an image input section (unillustrated) via a personal computer or the like, is disposed below the developing devices 2*a* to 2*d*. The exposure unit 12 includes a laser light source, a polygon mirror, and optical systems 12*a* to 12*d* that correspond to the photosensitive members 11*a* to 11*d*, respectively, and that are each composed of a reflection mirror, a lens, etc. Laser light emitted from the laser light source travels via the polygon mirror, the reflection mirrors, and the lenses to reach the surfaces of the photosensitive members 11*a* to 11*d* at positions downstream of the chargers 13*a* to 13*d*, respectively, in the rotation direction of the photosensitive members 11*a* to 11*d*. Electrostatic latent images are formed on the photosensitive members 11*a* to 11*d* by the irradiation of the laser light. The electrostatic latent images are respectively developed into toner images by the developing devices 2*a* to 2*d*.

An endless intermediate transfer belt 17 is wound around a tension roller 6, a driving roller 25, and a driven roller 27. The driving roller 25 is driven to rotate by an unillustrated motor. The intermediate transfer belt 17 is driven to rotate by the rotation of the driving roller 25.

The photosensitive members 11*a* to 11*d* are adjacently arranged (in series) along a sheet transporting direction (a direction indicated by an arrow in FIG. 1) under and in contact with the intermediate transfer belt 17. Primary transfer rollers 26*a* to 26*d* are opposed to the photosensitive members 11*a* to 11*d*, respectively, with the intermediate transfer belt 17 therebetween, and the primary transfer rollers 26*a* to 26*d* are pressed against the intermediate transfer belt 17 to form a primary transfer portion. At the primary transfer portion, at predetermined timings with respect to the rotation of the intermediate transfer belt 17, the toner images of the photosensitive members 11*a* to 11*d* are transferred onto the intermediate transfer belt 17 in sequence. As a result, the toner images, which are respectively of magenta, cyan, yellow, and black, are superimposed on one another on the surface of the intermediate transfer belt 17, and thereby a toner image is formed.

A secondary transfer roller 34 is opposed to the driving roller 25 with the intermediate transfer belt 17 therebetween, and the secondary transfer roller 34 is pressed against the intermediate transfer belt 17 to form a secondary transfer portion. At the secondary transfer portion, the toner image on the intermediate transfer belt 17 is transferred onto a sheet P. After the transfer, a belt cleaning device 31 removes toner remaining on the intermediate transfer belt 17.

At a lower portion within the image forming apparatus 1, there is disposed a sheet-feeding cassette 32 in which sheets P are placed. To the right of the sheet-feeding cassette 32, there is disposed a stack tray 35 for manual sheet feeding. To the left of the sheet-feeding cassette 32, there is disposed a first sheet conveying path 33 through which a sheet P fed from the sheet-feeding cassette 32 is conveyed to the secondary transfer portion of the intermediate transfer belt 17. Furthermore, to the left of the stack tray 35, there is disposed a second sheet conveying path 36 through which the sheet from the stack tray 35 is conveyed to the secondary transfer portion. Moreover, to the upper-left of the image forming apparatus 1, there is disposed a fixing section 18 that performs a fixing process on the sheet P having the toner image formed thereon, and there is also disposed a third sheet conveying path 39 through which the sheet P that has undergone the fixing process is conveyed to a sheet ejection section 37.

The sheet-feeding cassette 32 is able to be drawn out of the image forming apparatus 1 (toward the front side from the surface of the sheet on which FIG. 1 is drawn) to be refilled with sheets P. The sheets P placed in the sheet-feeding cassette 32 are sent out one by one toward the first sheet conveying path 33 by a pickup roller 33*b* and a retard roller 33*a*.

The first conveying path 33 and the second sheet conveying path 36 join together at a position upstream of a pair of resist rollers 33*c* in sheet conveying directions. The resist rollers 33*c* convey a sheet P to the secondary transfer portion by adjusting timing of the sheet-feeding operation to be in accordance with the image forming operation performed at the intermediate transfer belt 17. At the secondary transfer portion, the secondary transfer roller 34 having a transfer bias applied thereto performs secondary transfer of the toner image formed on the intermediate transfer belt 17 onto the sheet P, and then the sheet P is conveyed to the fixing section 18.

The fixing section 18 includes, for example, a fixing belt that is heated by a heater or the like, a fixing roller that internally touches the fixing belt, and a pressing roller that is in press contact with the fixing roller with the fixing belt located therebetween. At the fixing device 18, where the fixing process is performed, heat and pressure are applied to the sheet P onto which the toner image has been transferred, to thereby fix the toner image on the sheet P. After the toner image is fixed on the sheet P at the fixing section 18, the sheet P is reversed through a fourth sheet conveying path 40 if necessary. By reversing the sheet P, it is possible to secondarily transfer a toner image onto the back side of the sheet F at the secondary transfer roller 34. The sheet P having the toner image transferred onto the back side thereof undergoes the fixing process again at the fixing section 18. The sheet P on which the toner image or images is or are fixed goes through the third sheet conveying path 39 to be ejected to the sheet ejection section 37.

Figure 2:
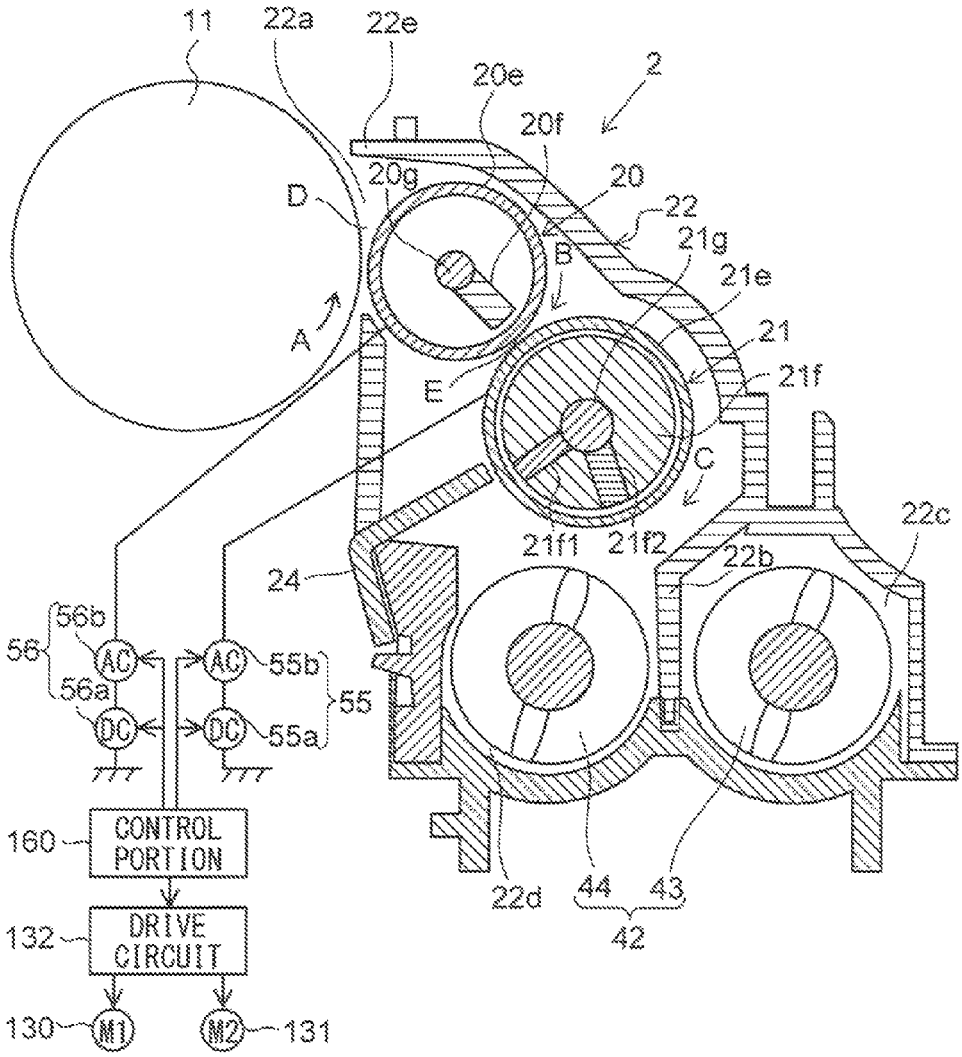
FIG. 2 is a sectional view schematically showing a developing device incorporated in an image forming apparatus according to an embodiment of the present disclosure.

FIG. 2 is a sectional view showing the structure of the developing devices used in the image forming apparatus 1 described above. The following descriptions will deal with the structure and the operation of the developing device 2*a* corresponding to the photosensitive member 11*a* shown in FIG. 1. The developing devices 2*b* to 2*d* each have the same structure and operate in the same manner as the developing device 2*a*, and thus their descriptions will be omitted, and in the following descriptions, the developing device and the photosensitive member will be denoted without reference signs "a" to "d" which indicate different colors; the reference signs "a" to "d" will be given if necessary.

The developing device 2 is composed of, for example, a developing roller 20, a magnetic roller 21, an agitation portion 42, a regulation, member 24, and a developing container 22.

The developing container 22 constitutes the contour of the developing device 2, and a lower portion of the developing container 22 is separated by a partition member 22*b* into a first conveying path 22*d* and a second conveying path 22*c*. The first and second conveying paths 22*d* and 22*c* hold therein a two-component developer containing a toner and a magnetic carrier. Furthermore, the developing container 22 rotatably holds first and second agitation members 44 and 43 of the agitation portion 42, the magnetic roller 21, and the developing roller 20. Moreover, the developing container 22 has an opening 22*a* formed in a top portion 22*e* thereof such that the developing roller 20 is exposed toward the photosensitive member 11 through the opening 22*a*.

The agitation portion 42 is provided in a bottom portion of the developing container 22, and includes the first agitation member 44 and the second agitation member 43. The first agitation member 44 is disposed inside the first conveying path 22*d*, and the second agitation member 43 is disposed inside the second conveying path 22*c* such that the second agitation member 43 is located to the right of and adjacent to, the first agitation member 44.

The first and second agitation members 44 and 43 agitate the developer to charge the toner contained in the developer to a predetermined charge level. Thereby, the toner is held on the magnetic carrier. Furthermore, communication portions (unillustrated) are formed at two ends of the partition member 22*b* separating the first conveying path 22*d* from the second conveying path 22*c* in the longitudinal direction of the partition member 22*b* (the back-front direction of the sheet on which FIG. 2 is drawn). When the second agitation member 43 rotates, the charged developer is conveyed from one of the communication portions formed in the partition member 22*b* into the first conveying path 22*d*, and the developer circulates inside the first conveying path 22*d* and inside the second conveying path 22*c*. Then, the developer is fed from the first agitation member 44 to the magnetic roller 21.

The magnetic roller 21 is disposed above the first agitation member 44 to be opposed to the agitation member 44, and the magnetic roller 21 carries and conveys the developer fed front the first agitation member 44, and feeds the toner alone to the developing roller 20. The regulation member 24 is disposed to be opposed to the circumferential surface of the magnetic roller 21.

The regulation member 24 is a plate-shaped member made of a magnetic material such as stainless steel, and the regulation member 24 is fixed to the developing container 22 at a position to the lower left of the magnetic roller 21 and below the developing roller 20. An end portion of the regulation member 24 is located opposed to the surface of the magnetic roller 21 with a predetermined distance therebetween, and thereby, the regulation member 24 regulates the layer thickness of the developer carried on the surface of the magnetic roller 21.

The magnetic roller 21 includes a rotation sleeve 21*e* that is made of a nonmagnetic material, a magnetic pole member 21*f*, and a roller shaft 21*g*.

The magnetic pole member 21*f* includes magnets of different polarities along the peripheral portion. The magnetic pole member 21*f* has a regulation pole 21*f*1 that is an N magnetic pole and located at a position opposed to the regulation member 24, and further has a collection pole 21*f*2 in which two magnetic poles having the same polarity are adjacently arranged along the circumferential direction. The collection pole 21*f*2 has a magnetic force that is weaker compared with that of any other magnetic pole included in the magnetic pole member 21*f*. With this structure, the developer is not allowed to be carried on such a part of the surface of the magnetic roller 21 that is located opposed to the collection pole 21*f*2, and a residue of the developer remaining without being used for the development is collected to the agitation portion 42 side. The magnetic pole member 21*f* is fixed by bonding or the like to the roller shaft 21*g*, and the roller shaft 21*g* is non-rotatably supported by the developing container 22.

The rotation sleeve 21*e* is disposed around the magnetic pole member 21*f* at a predetermined distance therefrom, thereby allowing the developer to be carried as a magnetic brush on the surface of the rotation sleeve 21*e*. Furthermore, the rotation sleeve 21*e* is rotatably supported by the developing container 22 and conveys the magnetic brush by being rotated in an arrow C direction by a drive mechanism composed of a developing motor 131 and an unillustrated gear. Moreover, a first bias is applied to the rotation sleeve 21*e*. The first bias is obtained by a first voltage applying portion 55 superimposing an AC bias on a DC bias. The first voltage applying portion 55 is composed of a DC power supply 55*a* and an AC power, supply 55*b*.

The developing roller 20 is disposed to the upper left of the magnetic roller 21 to be opposed to the magnetic roller 21 at a facing position E with a predetermined distance therebetween. The developing roller 20 includes a developing sleeve 20*e*, a magnetic pole member 20*f*, a stationary shaft 20*g*, etc.

The developing sleeve 20*e* is formed of a non-magnetic material in a cylindrical shape, and is rotatably supported by the developing container 22. The magnetic pole member 20*f* is disposed at a predetermined distance from the developing sleeve 20*e*, and the magnetic pole member 20*f* is fixed by bonding or the like to the stationary shaft 20*g* to be opposed to the facing position E. The stationary shaft 20*g* is non-rotatably supported by the developing container 22. Furthermore, the developing sleeve 20*e* is disposed to the right of, and opposed to, the photosensitive member 11 at a given distance therefrom, the developing sleeve 20*e* forming a developing region D where the toner is fed from the developing sleeve 20*e* to the photosensitive member 11. The developing sleeve 20*e* is rotated in an arrow B direction, which is a direction that is the same as the direction in which the rotation sleeve 21*e* of the magnetic roller 21 rotates, by the drive mechanism composed of the developing motor 131 and the unillustrated gear. Thus, the developing sleeve 20*e* rotates to move upward at the position opposed to the photosensitive member 11, and to move at the facing position E in a direction opposite to the direction in which the rotation sleeve 21*e* moves. Furthermore, a second bias is applied to the developing sleeve 20*e*. The second bias is obtained by a second voltage applying portion 56 superimposing an AC bias on a DC bias. The second voltage applying portion 56 is composed of a DC power supply 56*a* and an AC power supply 56*b*.

Thus, on the surface of the rotation sleeve 21*e* of the magnetic roller 21, the charged developer is carried while forming a magnetic brush under the magnetic force of the magnetic pole member 21*f*. The magnetic brush is conveyed by the rotation sleeve 21*e* being rotated by the developing motor 131 in the arrow C direction. The layer thickness of the magnetic brush is adjusted to be a predetermined thickness by the regulation member 24 and the regulation pole 21*f*1. The magnetic brush having the predetermined layer thickness as a result of the adjustment is conveyed to the facing position E by the rotation sleeve 21*e*. At the facing position E, the magnetic brush is raised into contact with the developing sleeve 20*e* by the magnetic pole member 20*f* of the developing roller 20. Here, by applying the first and second biases with a potential difference provided between the first bias of the first voltage applying portion 55 and the second bias of the second voltage applying portion 56, only the toner contained in the magnetic brush is led to the developing sleeve 20*e* from the rotation sleeve 21*e*. As for a residue of the magnetic brush remaining without being fed to the developing sleeve 20*e*, along with the rotation of the rotation sleeve 21*e* in the arrow C direction, due to the collection pole 21*f*2, it becomes unable to be carried on the rotation sleeve 21*e* and is conveyed back toward the first agitation member 44.

Next, the developing sleeve 20*e* is rotated by the developing motor 131 in the arrow B direction, and thereby the toner carried on the developing sleeve 20*e* is conveyed to the developing region D. Here, the second bias of the second voltage applying portion 56 is set to be larger than a bias applied to the photosensitive member 11. Due to the potential difference between the second bias potential and a potential at an exposed portion on the photosensitive member 11, the toner carried on the developing sleeve 20*e* flies toward the photosensitive member 11. Particles of the flying toner successively adhere to the exposed portion on the photosensitive member 11 as it is rotated in an arrow A direction by a drum motor 130, so that an electrostatic latent image on the photosensitive member 11 is developed.

In the image forming operation (printing mode) discussed above, the magnetic roller 21 (the rotation sleeve 21*e*) is rotated in the arrow C direction, the developing roller 20 (the developing sleeve 20*e*) is rotated in the arrow B direction, voltage application is performed with a potential difference between the first and second voltage applying portions 55 and 56, and a voltage that is larger than the potential of the surface of the photosensitive member 11 is applied to the developing roller 20 from the second voltage applying portion 56. The present embodiment includes a toner collecting mode as well as the printing mode.

In the toner collecting mode, part of the toner fed from the developing roller 20 to the photosensitive member 11 in forming an image may fall from the developing roller 20 onto the regulation member 24 as residual toner, and part of the toner may adhere to the internal wall of the developing container 22 located opposed to the developing roller 20 as residual toner, and such residual toner remaining without being used to develop the electrostatic latent image are collected to the agitation portion 42 side. The toner collecting mode is performed when no image formation is performed, for example, each time printing is performed on a predetermined number of sheets, or the toner collecting mode is performed when, for example, maintenance inspection of the image forming apparatus 1 is conducted.

A controller performs switching between the printing mode and the toner collecting mode and executes the printing mode and the toner collecting mode. The controller includes a control portion 160 and a drive circuit 132. The control portion 160 is composed of a microcomputer, a storage element such as an RAM and an ROM, etc. In accordance with a program and data set in the storage element, on the switching between the modes, the control portion 160 controls the drive circuit 132 that drives the drum motor 130 and the developing motor 131, or the control portion 160 controls the biases of the first and second voltage applying portions 55 and 56.

The drive circuit 132 is formed of a bridge circuit that applies a pulse voltage to the drum motor 130 and the developing motor 131, which are DC motors, for example, and thus drives the drum motor 130 and the developing motor 131 to rotate by applying a pulse voltage thereto. The drive circuit 132 further switches the rotation direction of the developing motor 131 by operating a switch in the bridge circuit. The control portion 160 transmits a forward direction signal or a backward direction signal to the drive circuit 132.

Based on the forward direction signal, the drive circuit 132 drives the drum motor 130 to rotate the photosensitive member 11 in the arrow A direction, and the drive circuit 132 also drives the developing motor 131 to rotate the developing roller 20 and the magnetic roller 21 in the arrow B direction and the arrow C direction, respectively. On the other hand, based on the backward direction signal, the drive circuit 132 drives the developing motor 131 so as to rotate the developing roller 20 in a direction opposite to the arrow B direction, and so as to rotate the magnetic roller 21 in a direction opposite to the arrow C direction. Switching to the forward or backward rotation direction may be performed also by using, as the drum motor 130 and the developing motor 131, stepping motors instead of DC motors.

Figure 3:
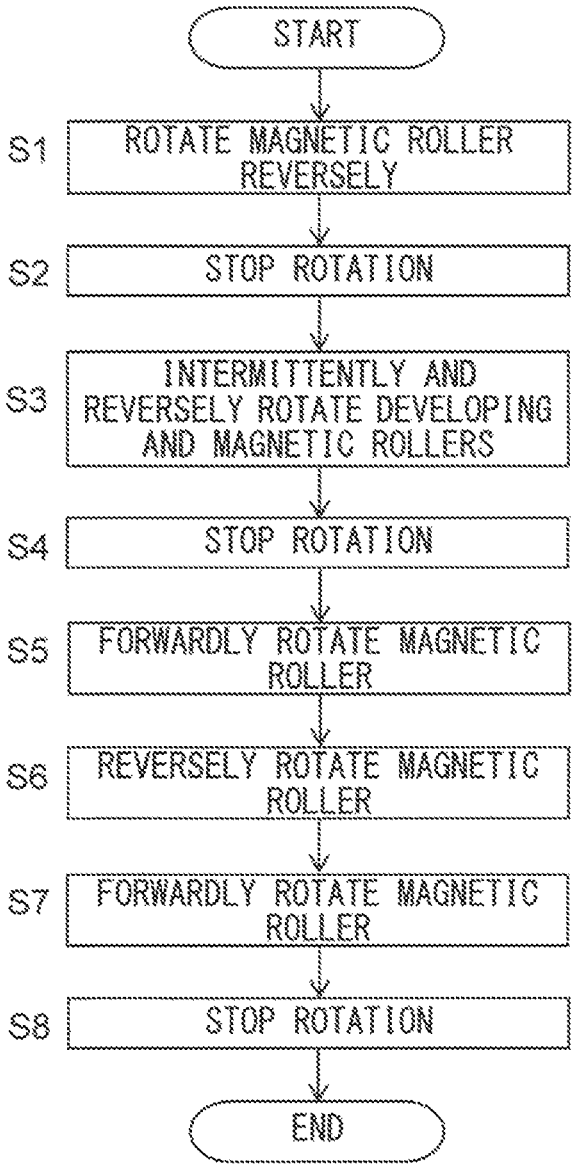
FIG. 3 is a flow chart showing a toner collecting mode performed by a controller according to an embodiment of the present disclosure.

The control portion 160 executes the toner collecting mode based on a flow chart shown in FIG. 3.

In step 1, the control portion 160 transmits the backward direction signal to the developing motor 131 via the drive circuit 132, and the control portion 160 gives an instruction to rotate the developing motor 131 at a rotational speed lower than in the printing mode. Based on the signal, the developing motor 131 is driven to rotate, and the magnetic roller 21 and the development roller 20 start rotating in the backward direction at a rotational speed lower than in the printing mode. The backward rotation of the magnetic roller 21 allows the magnetic brush on the magnetic roller 21 to scrape off the residual toner that has fallen onto the regulation member 24 or its vicinity, and the scraped-off residual toner is collected to the agitation portion 42 side. The rotation of the magnetic roller 21 at a rotation speed lower than in the printing mode allows the magnetic brush to softly scrape off the residual toner that has fallen to the vicinity of the regulation member 24, preventing the fallen residual toner from floating around the regulation member 24.

Further, in step 1, it is preferable that the first bias of the first voltage applying portion 55 and the second bias of the second voltage applying portion 56 be set to the same potential. With this setting, there is no potential difference between the developing roller 20 and the magnetic roller 21, and this helps prevent the toner from moving front the magnetic roller 21 to the developing roller 20.

In step 2, the developing motor 131 rotates a predetermined number of times, and then the control portion 160 stops the rotational driving of the developing motor 131.

In step 3, the control portion 160 transmits the backward direction signal and a rotation-stopping signal alternately to the developing motor 131 via the drive circuit 132 at predetermined timings, and the control portion 160 also gives an instruction to make the developing motor 131 rotate at a higher rotation speed than in the printing mode. Based on these signals, the developing motor 131 is driven to rotate, and the developing roller 20 and the magnetic roller 21 perform a first rotation in which they intermittently rotate backward at a rotation speed higher than in the printing mode. The intermittent rotation of the developing roller 20 and the magnetic roller 21 causes the developing container 22 to shake around portions at which the developing container 22 is fixed to, and held by, the image forming apparatus 1. This shaking of the developing container 22 causes the residual toner adhered to part of the internal wall of the developing container 22 around the opening 22*a* to fall onto the surface of the developing roller 20. In the first rotation, where developing roller 20 and the magnetic roller 21 rotate at a rotation speed higher than in the printing mode, the shaking of the developing container 22 is enhanced to make it easier for the residual toner adhered to the internal wall of the developing container 22 to fall. Further, in the first rotation, it is preferable that the intermittent rotation be carried out twice or more, at a minimum interval.

Furthermore, in step 3, the developing roller 20 rotates in the direction opposite to the direction in which it rotates in the printing mode, whereby the residual toner that has fallen onto the developing roller 20 is conveyed via the developing region D (see FIG. 2) on the developing roller 20 toward the facing position E (see FIG. 2), to fall onto the regulation member 24 or its vicinity.

Moreover, in step 3, there may be performed a photosensitive member-side collection mode where, in a state in which the surface of the photosensitive member 11 is uncharged, a voltage having the same polarity as the toner is applied to the developing roller 20 and the photosensitive member 11 is rotated in the same direction as the direction in which the photosensitive member 11 is rotated in the printing mode. Specifically, in a state where no voltage is applied to the charger 13 (see FIG. 1), the second bias is applied from the second voltage applying portion 56 (see FIG. 2) to the developing roller 20, and the photosensitive member 11 is rotated. Thereby, the residual toner fallen onto the developing roller 20 falls therefrom onto the vicinity of the regulation member 24, or moves in the developing region D onto the photosensitive member 11, and since the surface of the photosensitive member 11 is not charged (that is, the surface potential of the photosensitive member 11 is zero), the residual toner on the photosensitive member 11 is collected by the cleaning device 14 (see FIG. 1) along with the rotation of the photosensitive member 11. As a result the residual toner adhered to the internal wall of the developing container 22 is collected more securely. Note that the photosensitive member-side collection mode may be performed at other step in the toner collecting mode.

In step 4, the developing motor 131 intermittently rotates a predetermined number of times, and then the driving of the developing motor 131 is stopped.

Next, in step 5, the control portion 160 transmits the forward direction signal via the drive circuit 132 to the developing motor 131, and the control portion 160 also gives an instruction to rotate the developing motor 131 at a rotational speed lower than in the printing mode. Based on the signal, the developing motor 131 is driven to rotate, and the magnetic roller 21 and the development roller 20 rotate in the same direction as in the printing mode at a rotational speed lower than in the printing mode. In step 3, along with the driving of the developing motor 131, the magnetic roller 21 rotates, together with the developing roller 20, in a direction that is reverse to the direction in which they rotate in the printing mode, and the magnetic brush on the magnetic roller 21 is collected by collection pole 21*f*2 (see FIG. 2) to the agitation portion 42 side. There, a second rotation where the magnetic roller 21 rotates in the same direction as in the printing mode is performed, and thereby, a magnetic brush is formed on the magnetic roller 21.

In step 6, the control portion 160 transmits the backward direction signal via the drive circuit 132 to the developing motor 131, and the control portion 160 also gives an instruction to rotate the developing motor 131 at a rotation speed lower than in the printing mode. Based on the signal, the developing motor 131 starts rotating, and the magnetic roller 21 and the development roller 20 start rotating backward at a rotational speed lower than in the printing mode. A third rotation where the magnetic roller 21 rotates backward is performed, and in the third rotation, the magnetic brush on the magnetic roller 21 scrapes off the residual toner fallen onto the regulation member 24 or its vicinity, and the scraped-off residual toner is collected to the agitation portion 42 side. The rotation of the magnetic roller 21 at a rotation speed lower than in the printing mode allows the magnetic brush to softly scrape off the residual toner that has fallen onto the vicinity of the regulation member 24, preventing the fallen residual toner from floating around the regulation member 24.

In step 7, the control portion 160 transmits the forward direction signal via the drive circuit 132 to the developing motor 131. Based on the signal, the developing motor 131 is driven to rotate, and the magnetic roller 21 rotates in the same direction as in the printing mode. This rotation of the magnetic roller 21 allows the developer fed from the agitation portion 42 side to be conveyed to and carried on the magnetic roller 21, to form a magnetic brush on the magnetic roller 21. In step 8, the developing motor 131 rotates a predetermined number of times, and then the developing motor 131 is made to stop rotating, and the toner collecting mode is finished. This allows an image forming operation to be performed quickly on switching from the toner collecting mode to the printing mode.

Figure 4:
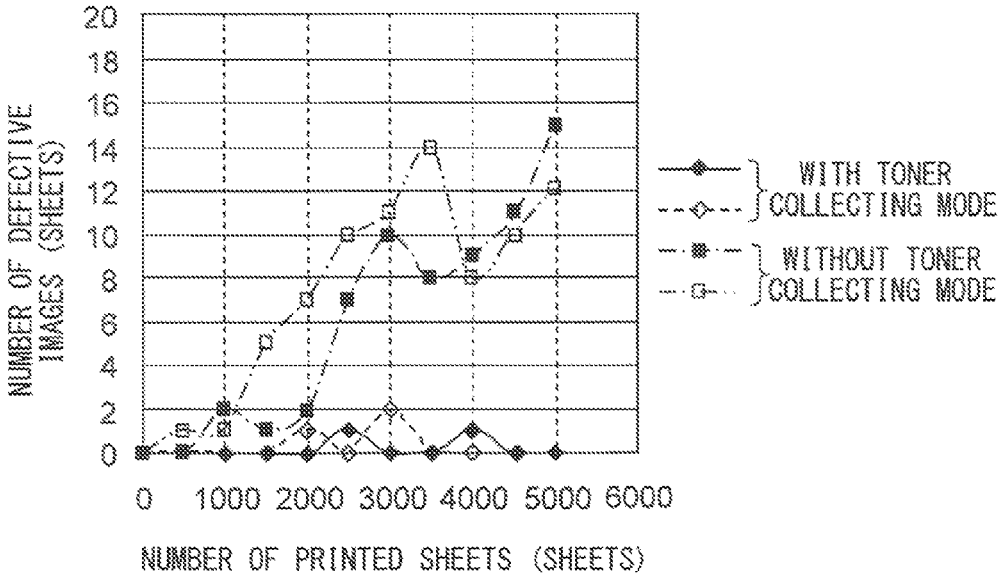
FIG. 4 is a diagram showing frequencies of defective images counted with and without an operation of the toner collecting mode.
Figure 5:
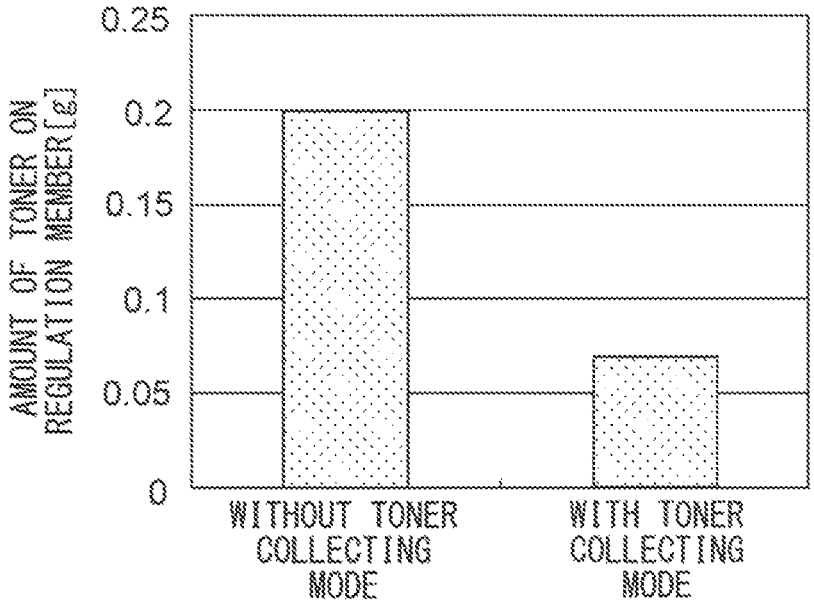
FIG. 5 is a diagram showing amounts of toner on a regulation member measured with and without the operation of the toner collecting mode.

The above-discussed toner collecting mode was performed, and in that case, as shown in FIGS. 4 and 5, less residual toner fell onto the regulation member 24 and a preferable image was obtained. FIG. 4 is a graph showing the frequency of the occurrence of defective images with or without the toner collecting mode, and FIG. 5 is a graph showing the amount of toner on the regulation member 24 with or without the toner collecting mode. For FIG. 4, the number of defective images was counted every 500 sheets of printing of a document with a coverage rate of 20%, under a high temperature and humid condition (temperature of 32.5° C., and relative humidity of 80%). This was conducted twice with the toner collecting mode performed and twice without the toner collecting mode, and thereby obtained numbers of defective images are plotted in FIG. 4. For FIG. 5, amounts of toner remaining on the regulation member 24 after printing on 5000 sheets under the above condition were measured.

As shown in FIG. 4, with the toner collecting mode performed, a preferable result was obtained where the frequency of the occurrence of defective images caused by, for example, toner clods was extremely low even after printing was performed on increased number of sheets. Furthermore, as shown in FIG. 5, with the toner collecting mode performed, a preferable result was obtained where the amount of toner remained on the regulation member 24 was as small as one third the amount of toner remained on the regulation member 24 without the toner collecting mode.

The present disclosure is applicable to an image forming apparatus such as a copier, a printer, a facsimile, and a multifunction peripheral having functions of those devices, and in particular, the present disclosure is applicable to an image forming apparatus that uses a developer containing a toner and a magnetic carrier, and that develops an electrostatic latent image formed on a photosensitive member by allowing only the toner to be carried on a developing roller.

What is claimed is:

1. An image forming apparatus comprising:

a developing device configured to develop an electrostatic latent image formed on a surface of an image carrier, the developing device comprising:

a developing container that holds therein a two-component developer containing a toner and a carrier;

a developing roller that feeds the toner to the image carrier, the developing roller being disposed to be opposed to the image carrier by part of an outer circumferential surface of the developing roller being exposed through an opening of the developing container, the developing roller configured to rotate such that part of the outer circumferential surface of the developing roller facing the image carrier moves upward;

a magnetic roller that is disposed to be opposed to the developing roller, the magnetic roller configured to rotate such that, at a position where the magnetic roller faces the developing roller, the magnetic roller moves in a direction that is reverse to a direction in which the developing roller moves, the magnetic roller configured to carry on a surface thereof a magnetic brush of the two-component developer by using which the magnetic roller forms a toner layer on the developing roller; and a regulation member that is disposed below the developing roller so as to be opposed to the magnetic roller with a predetermined distance between the regulation member and the magnetic roller, the regulation member configured to regulate a layer thickness of the developer on a surface of the magnetic roller; and a controller configured to control rotation of the developing roller and the magnetic roller of the developing device, the controller being configured to perform a toner collecting mode when no image formation is performed, the toner collecting mode including:

a first rotation in which the magnetic roller and the developing roller respectively rotate intermittently in directions opposite to directions in which the magnetic roller and the developing roller respectively rotate during image formation;

a second rotation that is performed after the first rotation, and in which the magnetic roller rotates in a direction in which the magnetic roller rotates during the image formation; and a third rotation that is performed after the second rotation, and in which the magnetic roller rotates in a direction opposite to the direction in which the magnetic roller rotates during the image formation, the controller thereby collecting toner remaining on the developing roller without being used to develop the electrostatic latent image back toward the magnetic roller, wherein the first rotation is performed at a rotation speed that is higher than a rotation speed during the image formation.

2. An image forming apparatus comprising:

a developing device configured to develop an electrostatic latent image formed on a surface of an image carrier, the developing device comprising:

a developing container that holds therein a two-component developer containing a toner and a carrier;

a developing roller that feeds the toner to the image carrier, the developing roller being disposed to be opposed to the image carrier by part of an outer circumferential surface of the developing roller being exposed through an opening of the developing container, the developing roller configured to rotate such that part of the outer circumferential surface of the developing roller facing the image carrier moves upward;

a magnetic roller that is disposed to be opposed to the developing roller, the magnetic roller configured to rotate such that, at a position where the magnetic roller faces the developing roller, the magnetic roller moves in a direction that is reverse to a direction in which the developing roller moves, the magnetic roller configured to carry on a surface thereof a magnetic brush of the two-component developer by using which the magnetic roller forms a toner layer on the developing roller; and a regulation member that is disposed below the developing roller so as to be opposed to the magnetic roller with a predetermined distance between the regulation member and the magnetic roller, the regulation member configured to regulate a layer thickness of the developer on a surface of the magnetic roller; and a controller configured to control rotation of the developing roller and the magnetic roller of the developing device, the controller being configured to perform a toner collecting mode when no image formation is performed, the toner collecting mode including:

a first rotation in which the magnetic roller and the developing roller respectively rotate intermittently in directions opposite to directions in which the magnetic roller and the developing roller respectively rotate during image formation;

a second rotation that is performed after the first rotation, and in which the magnetic roller rotates in a direction in which the magnetic roller rotates during the image formation; and a third rotation that is performed after the second rotation, and in which the magnetic roller rotates in a direction opposite to the direction in which the magnetic roller rotates during the image formation, the controller thereby collecting toner remaining on the developing roller without being used to develop the electrostatic latent image back toward the magnetic roller, wherein in the first rotation, the magnetic roller and the developing roller intermittently rotate twice or more.

3. An image forming apparatus comprising:

a developing device configured to develop an electrostatic latent image formed on a surface of an image carrier, the developing device comprising:

a developing container that holds therein a two-component developer containing a toner and a carrier;

a developing roller that feeds the toner to the image carrier, the developing roller being disposed to be opposed to the image carrier by part of an outer circumferential surface of the developing roller being exposed through an opening of the developing container, the developing roller configured to rotate such that part of the outer circumferential surface of the developing roller facing the image carrier moves upward;

a magnetic roller that is disposed to be opposed to the developing roller, the magnetic roller configured to rotate such that, at a position where the magnetic roller faces the developing roller, the magnetic roller moves in a direction that is reverse to a direction in which the developing roller moves, the magnetic roller configured to carry on a surface thereof a magnetic brush of the two-component developer by using which the magnetic roller forms a toner layer on the developing roller; and a regulation member that is disposed below the developing roller so as to be opposed to the magnetic roller with a predetermined distance between the regulation member and the magnetic roller, the regulation member configured to regulate a layer thickness of the developer on a surface of the magnetic roller; and a controller configured to control rotation of the developing roller and the magnetic roller of the developing device, the controller being configured to perform a toner collecting mode when no image formation is performed, the toner collecting mode including:

a first rotation in which the magnetic roller and the developing roller respectively rotate intermittently in directions opposite to directions in which the magnetic roller and the developing roller respectively rotate during image formation;

a second rotation that is performed after the first rotation, and in which the magnetic roller rotates in a direction in which the magnetic roller rotates during the image formation; and a third rotation that is performed after the second rotation, and in which the magnetic roller rotates in a direction opposite to the direction in which the magnetic roller rotates during the image formation, the controller thereby collecting toner remaining on the developing roller without being used to develop the electrostatic latent image back toward the magnetic roller, wherein the second rotation is performed at a rotation speed that is lower than the rotation speed during the image formation.

4. An image forming apparatus comprising:

a developing device configured to develop an electrostatic latent image formed on a surface of an image carrier, the developing device comprising:

a developing container that holds therein a two-component developer containing a toner and a carrier;

a developing roller that feeds the toner to the image carrier, the developing roller being disposed to be opposed to the image carrier by part of an outer circumferential surface of the developing roller being exposed through an opening of the developing container, the developing roller configured to rotate such that part of the outer circumferential surface of the developing roller facing the image carrier moves upward;

a magnetic roller that is disposed to be opposed to the developing roller, the magnetic roller configured to rotate such that, at a position where the magnetic roller faces the developing roller, the magnetic roller moves in a direction that is reverse to a direction in which the developing roller moves, the magnetic roller configured to carry on a surface thereof a magnetic brush of the two-component developer by using which the magnetic roller forms a toner layer on the developing roller; and a regulation member that is disposed below the developing roller so as to be opposed to the magnetic roller with a predetermined distance between the regulation member and the magnetic roller, the regulation member configured to regulate a layer thickness of the developer on a surface of the magnetic roller; and a controller configured to control rotation of the developing roller and the magnetic roller of the developing device, the controller being configured to perform a toner collecting mode when no image formation is performed, the toner collecting mode including:

a first rotation in which the magnetic roller and the developing roller respectively rotate intermittently in directions opposite to directions in which the magnetic roller and the developing roller respectively rotate during image formation;

a second rotation that is performed after the first rotation, and in which the magnetic roller rotates in a direction in which the magnetic roller rotates during the image formation; and a third rotation that is performed after the second rotation, and in which the magnetic roller rotates in a direction opposite to the direction in which the magnetic roller rotates during the image formation, the controller thereby collecting toner remaining on the developing roller without being used to develop the electrostatic latent image back toward the magnetic roller, wherein, after performing the third rotation, the controller rotates the magnetic roller in a same direction as during the image formation.

5. An image forming apparatus comprising:

a developing device configured to develop an electrostatic latent image formed on a surface of an image carrier, the developing device comprising:

a developing container that holds therein a two-component developer containing a toner and a carrier;

a developing roller that feeds the toner to the image carrier, the developing roller being disposed to be opposed to the image carrier by part of an outer circumferential surface of the developing roller being exposed through an opening of the developing container, the developing roller configured to rotate such that part of the outer circumferential surface of the developing roller facing the image carrier moves upward;

a magnetic roller that is disposed to be opposed to the developing roller, the magnetic roller configured to rotate such that, at a position where the magnetic roller faces the developing roller, the magnetic roller moves in a direction that is reverse to a direction in which the developing roller moves, the magnetic roller configured to carry on a surface thereof a magnetic brush of the two-component developer by using which the magnetic roller forms a toner layer on the developing roller; and a regulation member that is disposed below the developing roller so as to be opposed to the magnetic roller with a predetermined distance between the regulation member and the magnetic roller, the regulation member configured to regulate a layer thickness of the developer on a surface of the magnetic roller; and a controller configured to control rotation of the developing roller and the magnetic roller of the developing device, the controller being configured to perform a toner collecting mode when no image formation is performed, the toner collecting mode including:

a first rotation in which the magnetic roller and the developing roller respectively rotate intermittently in directions opposite to directions in which the magnetic roller and the developing roller respectively rotate during image formation;

a second rotation that is performed after the first rotation, and in which the magnetic roller rotates in a direction in which the magnetic roller rotates during the image formation; and a third rotation that is performed after the second rotation, and in which the magnetic roller rotates in a direction opposite to the direction in which the magnetic roller rotates during the image formation, the controller thereby collecting toner remaining on the developing roller without being used to develop the electrostatic latent image back toward the magnetic roller, wherein, before performing the first rotation, the controller rotates the magnetic roller at a rotation speed lower than during the image formation, in a direction reverse to a direction in which the magnetic roller is rotated during the image formation.

6. The image forming apparatus of claim 1, further comprising a voltage applying portion that applies a bias to the developing roller, wherein when the magnetic roller and the developing roller are performing the first rotation, the controller controls the voltage applying portion to apply a voltage of a same polarity as the toner to the developing roller, and the controller rotates the image carrier, in a state where a surface thereof is uncharged, in a same direction as during the image formation.

7. The image forming apparatus of claim 1, wherein the toner collecting mode is performed each time printing is performed on a predetermined number of sheets.

8. The image forming apparatus of claim 1, wherein the toner collecting mode is performed when maintenance inspection of the image forming apparatus is performed.

9. The image forming apparatus of claim 1, wherein the controller comprises:

a drive circuit that drives a developing motor for rotating the magnetic roller and the developing roller; and a controlling portion that controls the drive circuit, wherein the drive circuit includes a bridge circuit that applies a pulse voltage to the developing motor, and the developing motor is formed of a DC motor.

* * * * *